United States Patent [19]

Friedman

[11] Patent Number: 4,692,239

[45] **Date of Patent: * Sep. 8, 1987**

[54] METHOD OF RECOVERING HYDROCARBON FROM OIL SHALE

[75] Inventor: Robert H. Friedman, Houston, Tex.

[73] Assignee: Texaco Inc., White Plains, N.Y.

[ * ] Notice: The portion of the term of this patent subsequent to Jan. 28, 2003 has been disclaimed.

[21] Appl. No.: 880,362

[22] Filed: Jun. 30, 1986

[51] Int. Cl.[4] ..... C10G 1/00

[52] U.S. Cl. ..... 208/430; 208/431; 208/435

[58] Field of Search ..... 208/433, 431, 435, 403, 208/430

[56] References Cited

U.S. PATENT DOCUMENTS

| | | | |
|---|---|---|---|
| 4,094,766 | 6/1978 | Gorin | 208/433 X |
| 4,176,040 | 11/1979 | Hazlett | 208/433 X |
| 4,324,641 | 4/1982 | Durai-Swamy | 208/431 X |
| 4,566,964 | 1/1986 | Friedman | 208/435 X |

*Primary Examiner*—Andrew H. Metz
*Assistant Examiner*—Glenn Caldarola
*Attorney, Agent, or Firm*—Jack H. Park; Kenneth R. Priem

[57] ABSTRACT

Hydrocarbons may be recovered from crushed oil shale by contacting the coarsely crushed oil shale material with a hydrogen doner solvent such as tetralin, alone or in combination with high pressure gaseous hydrogen for a period of time sufficient to cause disintegration of the oil shale lumps, after which the pretreated material is introduced into a vessel containing a free oxygen containing gas such as air in a fluid environment at a temperature range from 30° to 43° C. to remove organic fragments from the polymeric kerogen component of oil shale by oxidative scissions. The oxidation is conducted using a liquid phase solvent for the organic fractions removed from the kerogen. Preferred solvents are naphthalene, tetralin and phenanthracene. The solvent-organic fraction solution is then separated into solvent and organic fraction by sublimation with the solvent being recycled. The residual solids comprising oil shale material and unoxidized kerogen is then subjected to a bake-off to recover additional organic material from the kerogen. In addition to recovering a portion of the organic content from the kerogen, the oxidative scission reaction increases the susceptibility of the kerogen to recovery by pyrolysis under milder conditions than the unoxidized oil shale material. The pyrolysis is conducted at a temperature from 400° F. to 750° F. for a time period up to 2 hours.

29 Claims, 1 Drawing Figure

METHOD OF RECOVERING HYDROCARBON FROM OIL SHALE

CROSS REFERENCE TO RELATED PATENT AND APPLICATION

This application is closely related to U.S. Pat. No. 4,566,964 which issued Jan. 28, 1986 for Method of Recovering Hydrocarbon from Oil Shale (208/8LE). It is also related to copending application for Method for In Situ Recovery of Hydrocarbons from Subterranean Oil Shale Deposits, Ser. No. 6/880,254, filed on 6/30/1986.

FIELD OF THE INVENTION

This invention concerns a new and novel method for recovering hydrocarbon materials from oil shale. More specifically, this invention is concerned with a method for recovering hydrocarbon from oil shale by means other than retorting. Still more specifically, this invention is concerned with a method for recovering hydrocarbon from oil shale material which is mined and crushed and then subjected first to pretreatment with a hydrogen donor solvent and gaseous hydrogen and subsequently to a chemical oxidation to remove at least a portion of the hydrocarbon material from the oil shale.

BACKGROUND

Throughout the world there are vast reserves of hydrocarbons in the form of oil shales. Oil shales are sedimentary inorganic materials that contain appreciable organic material in the form of high molecular weight polymers. The inorganic portion of the oil shale is a marlstone-type sedimentary rock. Most of the organic material is present as kerogen, a solid, high molecular weight, three dimensional polymer which is insoluble in conventional organic solvents. Usually the naturally-occurring oil shales contain a small amount of a benzene-soluble organic material which is referred to as bitumen.

The most extensive oil shale deposits in the United States are the Devonian-Mississippian shales. The Green River formation of Colorado, Utah and Wyoming is a particularly rich deposit, and includes an area in excess of 16,000 square miles. The in-place reserves of the Green River formation alone exceed 3 trillion barrels. The Piceance Basin of Colorado represents nearly 85 percent of the Green River reserves.

A typical Green River Oil Shale is comprised of approximately 85 wt. percent mineral (inorganic) components, of which the carbonates are the predominate species, and lesser amounts of feldspars, quartz and clays are also present. The kerogen component represents essentially all of the organic material, and the elemental analysis is approximately 78% carbon, 10% hydrogen, 2% nitrogen, 1% sulfur and 9% oxygen.

Most of the methods for recovering hydrocarbon or organic material from oil shale materials involve mining the oil shale material, crushing it, and subjecting the crushed oil shale materials to thermal decomposition. The thermal decomposition of oil shale, i.e. pyrolysis or retorting, yields liquid, gases and solid (coke) products. The relative amounts of oil, gas and coke produced are controlled primarily by varying the parameters of temperature and time during the course of retorting the oil shale. Modern oil shale retorting processes operate at about 480° C., (896° F.) in order to maximize the yield of liquid hydrocarbon products. It has been reported in the literature that oil yield decreases and the retort gas increases with increased retorting temperature. It has also been reported that the aromatic content of the synthetic crude oil produced in retorting of oil shale increases with increased temperature.

Several major problems remain unsolved in the commercialization of the processes for recovering hydrocarbon from oil shale by retorting. A substantial amount of the hydrocarbon component of the oil shale is consumed by combustion to generate the high temperatures needed for the pyrolysis reaction. The synthetic crude produced is very high in olefins and low in saturates and aromatics, and so a substantial amount of hydrogen must be added to produce a good quality crude suitable for conventional refining. The hydrocarbon fraction which is produced in the gaseous state in the retorting process is greatly diluted by carbon dioxide resulting not only from the combustion of hydrocarbon portions of the oil shale, but also from thermal decomposition of the carbonate mineral fraction of the oil shale. Since dolomite and calcite are stable at temperatures far above the normal retorting temperatures, most of this carbon dioxide is derived from decomposition of dawsonite and nahcolite.

The state of the art retorting method only recovers about 56% of the kerogen as a useful product. Because of this, as well as the other problems discussed above, there is essentially no commercial production of synthetic crude oil from oil shale materials in the United States at the present time despite the enormous reserves represented by the oil shale deposits. It can be seen from the foregoing discussion that there is a substantial, unfulfilled need for a new process for recovering useful hydrocarbon products from oil shale by a process which reduces the cost for recovering the oil, or increases the percent of kerogen converted to useful product, or preferably both.

In my U.S. Pat. No. 4,566,964 which issued Jan. 28, 1986 for a method of recovery of hydrocarbon from oil shale, there is disclosed a process in which the mined oil shale material is crushed and ground to a predetermined fineness and then contacted with a free oxygen containing gas such as air in a solvent for the organic fragments which are extracted from the polymeric kerogen components. The preferred solvents are naphthalene, tetralin and phenanthracene. The solvent which contains the organic fractions separated from the kerogen polymer is then separated into solvent and the organic fraction by sublimation. The residual solids comprising mineral and unoxidized kerogen is then subjected to a bake-off to recover additional organic materials from kerogen. This process permits recovery of hydrocarbon from oil shale materials using much lower temperatures than conventional retorting techniques, and accomplishes an increased recovery efficiency. The method does require that the oil shale material which is removed from the subterranean formation be crushed and ground to a relatively fine consistency, in the order of about 100 mesh or less being preferred. The cost of this grinding operation is substantial and it is an object of the present invention to reduce the amount of time and energy which must be expended on the crushed oil shale material by grinding in order to reduce the overall cost of extracting hydrocarbon from the oil shale material.

SUMMARY OF INVENTION

Briefly the process of my invention involves subjecting oil shale materials which have been removed from their original formation, crushed to a coarse texture which may include a substantial amount of chunks of oil shale minerals in the range of one inch or more, but not ground as usually necessary for chemical extraction. The coarse crushed oil shale material is then subjected to a "pickling" process in which the crushed oil shale material is exposed to a solvent for the hydrocarbon fraction which will ultimately be recovered from the oil shale, which solvent is also a hydrogen doner. Specifically tetralin has been found to be the especially preferred solvent for this first stage separation. Atomic hydrogen from the tetralin apparently diffuses into the otherwise almost impermeable oil shale material, even in the coarse crushed chunks which are utilized in this process. A substantial disintegration of the physical structure of the mineral constituting the oil shale occurs. It is theorized that this disintegration occurs as a consequence of atomic hydrogen from the tetralin migrating into the oil shale material pieces, and when this hydrogen contacts naturally occurring oxygen within the oil shale material, a reaction occurs which may approach an explosion in nature, which causes a physical shattering of the rock matrix. In one embodiment, the mixture of crushed oil shale and tetralin is pressurized with gaseous hydrogen at a pressure in the range of from 50 to 200 and preferably 80 to 120 pounds per square inch for a period of from 3 to 10 days, sufficient to ensure maximum penetration of the hydrogen into the oil shale material.

The treated oil shale material is then removed from the pretreating chamber and subjected to a chemical oxidation by exposing the pretreated, crushed oil shale material to an oxidizing fluid environment comprising a heated liquid solvent for the second stage extracted material plus a free oxygen-containing gas. More specifically, the pretreated oil shale material is exposed to a reaction environment comprising a solvent for the second stage extracted product, preferably naphthalene, tetralin or phenanthracene saturated with a free oxygen-containing gas such as air, at a temperature from 60° to 120° C. and preferably 70° to 100° C. Oxidation scission of the kerogen removes a portion of the kerogen from the crushed and chemically shattered oil shale solids, and also modifies the residual kerogen so as to make it more susceptible to subsequent heat treatment. In a preferred embodiment, the residual solid mineral and unreacted kerogen are then subjected to heat treatment at a temperature from 315° C. to 427° C. and preferably 371° C. to 399° C. in order to separate the remaining kerogen from the oil shale solids and convert the kerogen to useful, lower molecular weight organic materials. When employing certain of the preferred embodiment of the process of my invention, as much as 93% of the total organic carbon present in the raw oil shale material is recovered, compared to about 56% for conventional surface retorting methods, which represents a 62% increase in recovery.

BRIEF DESCRIPTION OF THE DRAWING

The attached drawing illustrates a preferred embodiment of the process of my invention whereby oil shale materials are mined, crushed, chemically treated with tetralin and hydrogen to shatter or disintegrate the coarse crushed oil shale material, and then subjected to oxidative scission which recover hydrocarbon from kerogen after which the residual kerogen is removed by heat treatment at reduced temperatures over that required for retorting.

DETAILED DESCRIPTION OF THE PREFERRED EMBODIMENTS

Figure 1:
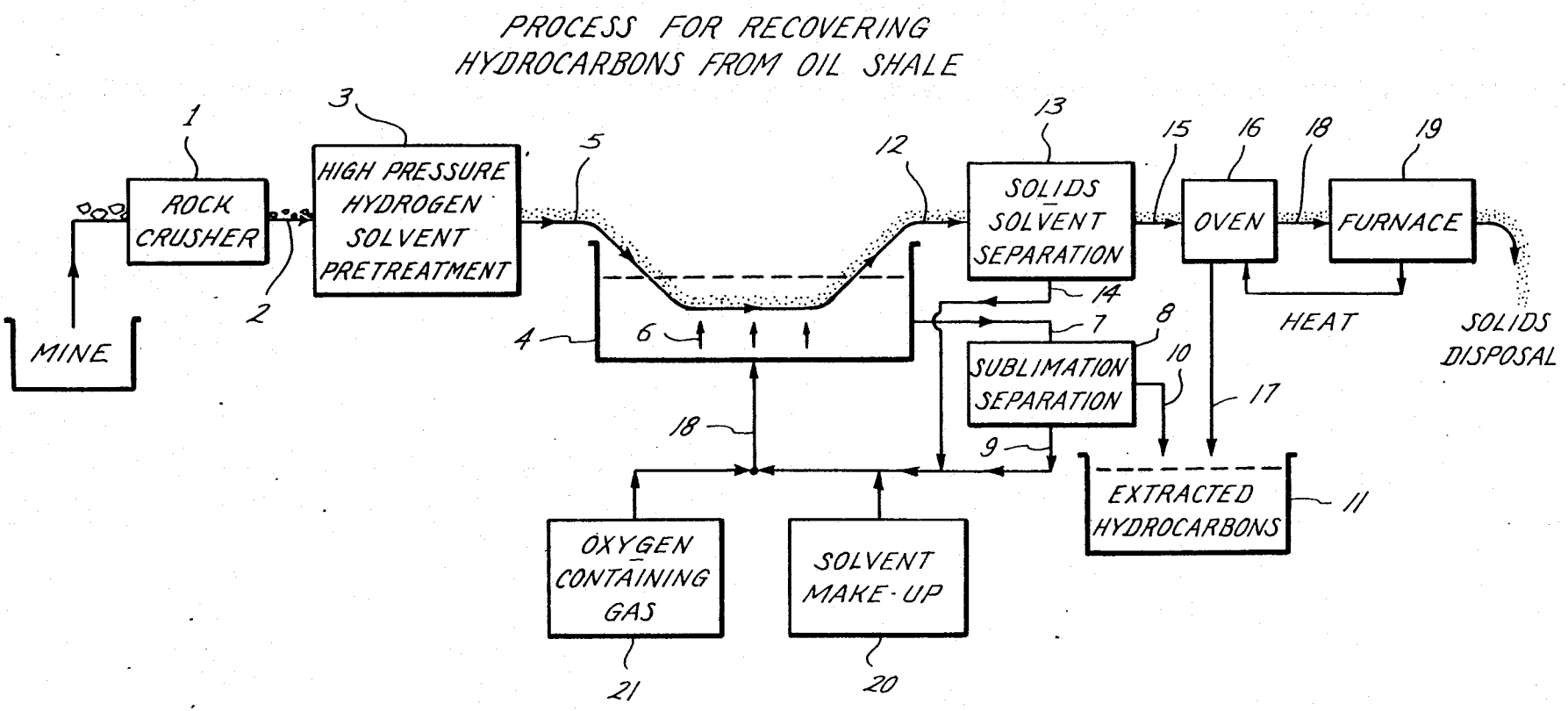

The objective of the research which lead to the discovery of the method that constitutes my invention was the development of a process for recovering usable products from oil shale, which utilized a minimum amount of both energy and water. The reduction in energy was desirable in order to improve the economics of the process as compared to state-of-the-art surface retorting techniques, and the reason for developing a system which requires a minimum amount of water was the fact that water is in very short supply in the areas where the largest and richest oil shale deposits are located. The chemical pretreatment was specifically designed to reduce the energy and cost of grinding the oil shale materials to allow contact between the oxidizing environment and the kerogen.

In my U.S. Pat. No. 4,566,964, it was necessary to grind the mined and crushed oil shale material to a fairly fine texture for the purpose of achieving contact between the oxidative environment and the kerogen fraction of the oil shale mineral. I have now discovered that fairly coarsely crushed oil shale material can be treated chemically in order to cause disintegration of the mineral material to a degree sufficient to provide the desired access between the oxidative environment described in U.S. Pat. No. 4,566,964 and the kerogen present in the oil shale. The present invention, therefore, comprises a pretreatment step to be applied to oil shale material which has been mined from a subterranean deposit and crushed, but not ground to the fineness required in the above described patent. Rather, the coarsely crushed oil shale material is placed in a chamber and subjected to a hydrogen doning solvent, preferably tetralin, for a period of time sufficient to allow penetration of atomic hydrogen from the tetralin solvent by diffusion into the unground chunks of oil shale mineral. In one preferred embodiment, the chamber in which the tetralin and coarse crushed oil shale are placed is pressurized with gaseous hydrogen and allowed to remain for a period of time, in the range of from 3 to 10, preferably 3 to 5 days, sufficient for the chemical disintegration of the coarse chunks of oil shale mineral to proceed to a point where it may be further subjected to the process of my invention. In another preferred embodiment, chemical fracturing of the coarse chunks of oil shale is accomplished by simply immersing the coarsely crushed oil shale in tetralin and allowing it to remain exposed to tetralin at atmospheric pressure or above for a period of time in the range of from about 3 to 10 and preferably 3 to 5 days without the application of hydrogen. The presence of hydrogen reduces the amount of time necessary to achieve chemical fracturing of the coarse chunks, at least under certain conditions, but it increases the cost of the first stage pretreatment process.

After the coarsely crushed oil shale material has been exposed to tetralin, alone or in combination with gaseous hydrogen under pressure, for a period of time sufficient to cause significant fracturing and disintegration of the chunks of oil shale into a much finer texture material, the components are separated by centrifuge, filtering or other means. The tetralin may be reused in the chemical pretreatment process. The chemically fractured oil shale rock is then conveyed by suitable mechanical means into the chamber in which the oil shale material is subjected to a solvent saturated with air and preferably in which air exists in an excess of that amount which can be dissolved in the solvent and is present in the form of air bubbles passing through the solvent-oil shale mixture.

Reference is made to the experimental work reported in detail in U.S. Pat. No. 4,566,964 and such disclosure is incorporated herein by reference. Briefly, it was found that chemical separation of hydrocarbons from oil shale was achieved in a process in which ground oil shale materials were subjected to air and suitable solvents for the organic fractions extracted by oxidative scission from the kerogen polymer, specifially mixtures of air with naphthalene, tetralin and phenanthracene at temperatures of from 100° to 300° C. From 29.8 to 40.73% of the total organic carbon was recovered from the oil shale samples. It was also reported that the residual oil shale mineral which contain some unextracted kerogen could then be subjected to a bake-off stage at a temperature of 400° to 750° F. which increased the total recovery to a value in the range of 33 to 97%. Any of the variations in oxidative separation of organic fractions from the kerogen and the additional recovery by high temperature bake-off disclosed in U.S. Pat. No. 4,566,964 may be incorporated in the process of the present invention, utilizing oil shale materials which were first coarsely crushed and then subjected to the chemical treatment of this invention, then to the oxidative step optionally followed by the bake-off step.

The following summarizes the results of the various oxidation separation methods reported in U.S. Pat. No. 4,566,964.

TABLE 1

RESULTS OF VARIOUS OXIDATION METHODS

| EXAMPLE NO. | METHOD | TOC | % Removed |
|---|---|---|---|
| — | Untreated Tar Sand Material | 15.1 | — |
| 1 | Air/Naphthalene (100° C. pH 7) | 10.6 | 29.80 |
| 2 | Air/Naphthalene (100° C. pH 4) | 10.12 | 32.98 |
| 3 | Air/Naphthalene (100° C. pH 4) $KI/I_2$ | 9.16 | 39.34 |
| 4 | Air/Tetralin (100° C. pH 4) | 9.39 | 37.81 |
| 5 | Air/Naphthalene (100° C. pH 4) Phosphate | 9.23 | 38.87 |
| 6 | Air/Phenanthracene (100° C. pH 4 | 9.56 | 36.69 |
| 7 | Air/Phenanthracene (200° C.) | 9.10 | 39.74 |
| 8 | Air/Phenanthracene (300° C.) | 8.95 | 40.73 |
| 9 | Air/Phenanthracene (100° C.) 400° F. bake-off | 10.01 | 33.71 |
| 10 | Air/Phenanthracene (100° C.) 500° F. bake-off | 6.16 | 59.21 |
| 11 | Air/Phenanthracene (100° C.) 600° F. bake-off | 2.28 | 84.90 |
| 12 | Air/Phenanthracene (100° C.) 750° F. bake-off | .44 | 97.09 |
| 13 | No Oxidation/750° F. Bake-off | 3.75 | 75.17 |
| 14 | Air/Tetralin (100° C. pH 4) Phosphate | 9.27 | 38.61 |
| 15 | Air/Naphthalene (100° C. pH 4) Phosphate $KI/I_2$ | 9.17 | 39.27 |
| 16 | Air/Tetralin (100° C. pH 4) Phosphate $KI/I_2$ | 9.20 | 39.07 |

EXPERIMENTAL SECTION

The following experimental work is concerned only with the chemical pretreatment stage which is utilized to disintegrate coarsely crushed oil shale material prior to the oxidation described above and in the above mentioned patent.

In the first experiment, a cube of oil shale of roughly one inch on a side, was placed in a laboratory pressure chamber, or bomb. The bomb was evacuated and gaseous hydrogen was introduced into the bomb to a pressure of 300/lb per square inch, and allowed to remain in contact with the cube of oil shale for two days at ambient temperatures. Subsequently, the cube of oil shale material was subjected to oxidative scission with naphthalene and only an insignificant amount of hydrocarbon recovery was obtained. There was no visible change in the cube of oil shale material. This clearly indicated that hydrogen gas alone did not accomplish significant disintegration of the cube of oil shale material necessary to permit significant recovery of hydrocarbon fractions from the kerogen component of the oil shale by my oxidative scission process.

In the second experiment, a cube of oil shale rock from the same source was placed in a bomb and covered with tetralin. The cell was then pressurized with hydrogen to 300 pounds per square inch. The cube was allowed to remain in the tetralin environment pressurized with hydrogen for four days, after which it was removed and examined. Considerable shattering of the rock occurred, and the texture appeared as though it had been further crushed or even coarsely ground. The chemically shattered oil shale material was then subjected to oxidative scission using naphthalene and air, and approximately 40% of the total organic carbon content of the oil shale cube was recovered.

DESCRIPTION OF A PREFERRED PROCESS

For purposes of additional disclosure including a disclosure of the best mode, the following is a description of a preferred embodiment of the process of my invention. The understanding of this embodiment will be aided by reference to the attached drawing, in which oil shale material is dug from a mine and conveyed to a rock crusher 1 in which the rock is crushed to a rough texture containing chunks up to one inch in size. The crushed rock will then be conveyed via a suitable conveyor 2 into a vessel 3 in which a hydrogen-doner solvent, preferably tetralin, and optionally containing hydrogen gas to enhance the penetration of atomic hydrogen from tetralin into the large chunks of crushed oil shale material. The residence time of the coarse crushed rock in this pretreatment chamber 3 is about 3 days, and it may be necessary to utilize a plurality of pretreatment chambers in order to accomplish the desired capacity for a continuous process, with provision being made to introduce the coarse crushed rock into first one pretreatment chamber and then another, with the pretreated material being removed from the chamber after the desired period of time has elapsed, and then transferred into the next step, which is the oxidative reaction.

The pretreated mineral is then introduced into vessel 4 by conveyor 5 containing naphthalene, at a temperature at least sufficient to maintain the solvent in a liquid phase. Air is continually moving through the solvent in vessel 4. Ideally, the direction of flow 6 of the air is at a right angle to the direction of movement of the rock being conveyed through the reaction chamber to optimize contact between air and oil shale material. By adjusting the speed of the conveyor through reaction vessel 4, and the length of the portion of the conveyor which is immersed in the air-saturated solvent bath, the dwell time of the crushed oil shale material may be controlled at the desired level. It is preferred that the dwell time of the chemically pretreated, crushed oil shale material in the air-saturated solvent mixture be from 1 to 6 and preferably from 2 to 4 hours. The temperature of the solvent-air mixture should be held above the melting point and below the boiling point of the solvent being employed. Ordinarily this is in the range from 80° to 150° F. and preferably from 90° to 110° F. The solvent utilized in this process will be any material which is an effective solvent for the low molecular weight fragments removed from the kerogen portion of the oil shale material by oxygen scission. Furthermore, the solvent must be liquid and a relative low temperature range, ideally 80° to 150° F. and preferably 90° to 100° F. It preferably should sublime from a mixture of solvent and extracted low molecular weight fragments removed from the kerogen at atmospheric pressure at a temperature of from 20° to 200° F. and preferably from 90° to 100° F. Preferred solvents are naphthalene, tetralin and phenanthracene. Any free oxygen containing gas can be utilized, but because of cost and availability, air is the gas of choice. Some improvement may be realized if the oxygen content of the air is increased by blending essentially pure oxygen with air, but in many applications simply adding air to the solvent passing through the ground oil shale material in reaction vessel 4 is sufficient to accomplish the desired first step oxidative scission of the kerogen portion of the oil shale material.

The solution of low molecular weight fractions of kerogen, i.e. the extracted hydrocarbon produced in the oxidative scission step are withdrawn from container 4 via line 7 and transported to separation vessel 8, where the mixture of solvent and extracted hydrocarbon are separated by sublimation, with the solvent being recycled via line 9 back to the separation vessel 4, and the extracted hydrocarbon being transported via line 10 to a collection vessel 11. The temperature of the sublimation separation is in the range of from 90° to 120° F., depending on the solvent being utilized.

The residual solid material, i.e. the crushed oil shale material including the rock and the residual, unoxidized kerogen is transported further along conveyor 12 to a relatively low temperature separation vessel 13, which will be heated just enough to remove the solvent, said solvent being transported via line 14 back to join line 9, where it reenters the oxidative scission reaction vessel 4. The rock containing the unseparated kerogen and a small amount of unrecovered solvent is transported along conveyor 15 into a high temperature oven 16, where the rock is quickly heated to a temperature up to 750° F. This pyrolyzes and/or separates residual kerogen from the rock. Fluidized kerogen or pyrolysis products therefrom are transported via line 17 into the extracted hydrocarbon collection vessel 11. Hot rock from the bake-off separation stage 16 which may contain some residual kerogen and/or coke from the bake-off step can be transported via line 18 to furnace 19, where the residual hydrocarbon is burned to supply the heat necessary to operate the oven 16 as well as other separation units. Spent rock is then conveyed to a disposal site.

It can be seen that solvent from the sublimation separation stage 8 is mixed with solvent removed from the solid material in solvent separation stage 13, and mixed with additional solvent make-up 20 to the extent necessary to maintain the solvent level in vessel 4 at the desired level. The solvent is saturated with the free oxygen containing gas e.g. air from supply 21, and injected into reaction vessel 4 via line 22.

In an alternative embodiment of my invention, the bake-off step in stage 16 is operated at the upper end of the recommended range, i.e. about 750° F., and the effluent is sent to an oven operating at an intermediate temperature, say 600° F. The material which condenses in the second oven is a relatively high molecular weight material which can be used as a fuel for the ovens. Spent rock will be transported to the disposal site as in the embodiment described above.

While my invention has been described in terms of a number of specific illustrative embodiments, it is not so limited as many variations thereof will be apparent to persons skilled in the related art without departing from the true spirit and scope of my invention. It is my intention that my invention be limited only by the limitations imposed in the claims appended hereinafter below.

What is claimed is:

1. A method for recovering hydrocarbons from oil shale comprising mineral rock and kerogen materials comprising:

(a) crushing the oil shale to a coarse texture including chunks of one inch or more;

(b) exposing the crushed oil shale to a hydrogen doning solvent including tetralin for at least 3 days sufficient to accomplish at least partial disistegration of the oil shale mineral;

(c) exposing the oil shale material to an oxidative environment comprising a free oxygen-containing gas at a temperature of at least 60° C. for sufficient time to cause oxidative scission of a portion of the kerogen which produces organic fragments removed from the kerogen, said oxidative environment also including a liquid solvent for the organic fragments;

(d) separating the solent and organic fragments from the residual solids; and (e) separating the organic fragments from the solvent.

2. A method as recited in claim 1 wherein the solvent utilized in step (b) is tetralin.

3. A method as recited in claim 1 wherein the time which the crushed oil shale material is exposed to the hydrogen doning solvent in step (b) is from 3 to 5 days.

4. A method as recited in claim 1 wherein the time which the crushed oil shale material is exposed to the hydrogen doning solvent in step (b) is from 3 to 10 days.

5. A method as recited in claim 1 comprising the additional steps of exposing the mixture of hydrogen doning solvent in crushed oil shale material of step (d) to hydrogen gas at pressure of from 50 to 200 pounds per square inch.

6. A method as recited in claim 5 wherein the hydrogen pressure is maintained in the range of from 80 to 120 pounds per square inch.

7. A method as recited in claim 1 wherein the temperature of the oxidative environment is from 60° C. to 120° C.

8. A method as recited in claim 7 wherein the temperature is from 70° C. to 100° C.

9. A method as recited in claim 1 wherein the solvent used in step (c) is selected from the group consisting of naphthalene, tetralin, phenanthracene and mixtures thereof.

10. A method as recited in claim 9 wherein the solvent is naphthalene.

11. A method as recited in claim 9 wherein the solvent is tetralin.

12. A method as recited in claim 9 wherein the solvent is phenanthracene.

13. A method as recited in claim 1 wherein the solvent of step (c) is saturated with the free oxygen-containing gas.

14. A method as recited in claim 13 wherein there is also present excess free oxygen-containing gas.

15. A method as recited in claim 1 wherein the oil shale material is exposed to the free oxygen-containing gas for a period of from 1 to 6 hours.

16. A method as recited in claim 15 wherein the time of exposure is from 2 to 4 hours.

17. A method as recited in claim 1 wherein the oxidative environment also includes an acid.

18. A method as recited in claim 1 wherein sufficient weak acid is added to reduce the pH of the oxidative environment to a value in the range of from 4 to 7.

19. A method as recited in claim 18 wherein the acid is selected from the group consisting of acetic acid, phosphoric acid, sulfurous acid, sulfamic acid and mixtures thereof.

20. A method as recited in claim 1 wherein the oxidative environment also contains a mixture of potassium iodide and iodine.

21. A method as recited in claim 20 wherein the amount of the mixture of potassium iodide and iodine is from 0.25 to 1.0% by weight.

22. A method as recited in claim 20 wherein the molar ratio of the mixture of potassium iodide and iodine added to the oxidative environment is from 1/400 to 1/100.

23. A method as recited in claim 1 wherein an effective amount of an inorganic phosphate is added to the oxidative environment.

24. A method as recited in claim 23 wherein the inorganic phosphate is sodium phosphate.

25. A method as recited in claim 23 wherein the concentration of phosphate added to the oxidative environment is from 1 to 7% by weight.

26. A method as recited in claim 1 comprising the additional step of exposing the residual solids from the oxidative scission reaction to a temperature in the range from 550° to 800° F. for a period of 0.1 to 2 hours, and recovering components pyrolyzed and/or vaporized from the residual solids as a result of the high temperature bake-off.

27. A method as recited in claim 26 wherein the temperature is from 600° to 750° F.

28. A method as recited in claim 26 wherein the time that the solids are exposed to the elevated temperatures is from $\frac{1}{4}$ to $1\frac{1}{2}$ hours.

29. A method as recited in claim 26 wherein the time is from $\frac{1}{2}$ to 1 hour.

* * * * *